US007531064B2

(12) United States Patent
Schmidtke

(10) Patent No.: US 7,531,064 B2
(45) Date of Patent: May 12, 2009

(54) MACHINE FOR THE PRODUCTION/PROCESSING OF A MATERIAL WEB AND DAMPING DEVICE

(75) Inventor: Werner-Marcus Schmidtke, Altheim (DE)

(73) Assignee: Voith Patent GmbH (DE)

( * ) Notice: Subject to any disclaimer, the term of this patent is extended or adjusted under 35 U.S.C. 154(b) by 516 days.

(21) Appl. No.: 11/348,312

(22) Filed: Feb. 7, 2006

(65) Prior Publication Data

US 2006/0185811 A1 Aug. 24, 2006

(30) Foreign Application Priority Data

Feb. 22, 2005 (DE) ..... 10 2005 008 071

(51) Int. Cl.
*D21H 11/00* (2006.01)

(52) U.S. Cl. ..... 162/265; 162/272; 162/289; 162/341; 162/198

(58) Field of Classification Search ..... 162/265, 162/272, 289, 341, 342, 198
See application file for complete search history.

(56) References Cited

U.S. PATENT DOCUMENTS 2,951,007 A * 8/1960 Lippke ..... 162/198
3,103,463 A * 9/1963 Justus ..... 162/341
3,547,775 A * 12/1970 Bossen et al. ..... 162/198
3,562,108 A * 2/1971 Lopas ..... 162/341
3,853,694 A * 12/1974 Parker ..... 162/216
4,523,977 A 6/1985 Cantini
2003/0108678 A1 6/2003 Wegehaupt

FOREIGN PATENT DOCUMENTS

DE 3134783 * 3/1983
DE 3311822 3/1984
DE 3624466 1/1987
DE 10160725 6/2003

OTHER PUBLICATIONS

International Search Report dated Jun. 9, 2006 in EP 05111489.

* cited by examiner

*Primary Examiner*—Mark Halpern
(74) *Attorney, Agent, or Firm*—Hershkovitz & Associates, LLC; Abraham Hershkovitz

(57) ABSTRACT

Machine for the production/processing of a material web, in particular a fibrous web, for example of paper or board, which comprises at least one treatment section in which the material web can have a treatment fluid applied to it, the treatment section being connected or able to be connected to a treatment fluid source via at least one line connection, an elastically deformable compensating material arranged in a fluid holding chamber of the treatment fluid source or of the treatment section. Alternatively, a damping device may be connected to the line connection or arranged in the latter and/or delimits such a fluid holding chamber, and/or elastically deformable compensating material which, in at least one section of the line connection, defines or co-defines an effective line cross section.

25 Claims, 5 Drawing Sheets

MACHINE FOR THE PRODUCTION/PROCESSING OF A MATERIAL WEB AND DAMPING DEVICE

CROSS-REFERENCE TO RELATED APPLICATIONS

The present application claims priority under 35 U.S.C. 119 of German Patent Application No. 10 2005 008 071.5, filed on Feb. 22, 2005, the disclosure of which is expressly incorporated by reference herein in its entirety.

BACKGROUND OF THE INVENTION

1. Field of the Invention

The present invention relates to a machine for the production/processing of a material web, in particular a fibrous web, for example of paper or board, which comprises at least one treatment section in which the material web can have a treatment fluid applied to it, the treatment section being connected or able to be connected to a treatment fluid source via at least one line connection.

2. Discussion of Background Invention

Machines of this type are known, for example from the papermaking industry. Normally, such machines comprise a plurality of treatment sections in which a treatment liquid is added to the material web. For instance, for the purpose of moisture profiling of a paper web in a drying section or before a calender of a paper machine, use is made of nozzle moisteners which discharge water intermittently onto the paper web. For this purpose, the nozzle moisteners are connected via a line connection to a water supply and valves that can be driven in a pulsating manner are arranged in the nozzle moisteners.

As a result of the pulsating operation of the valves and the associated intermittent transport of the treatment liquid from the water supply through the line connection to the nozzle moisteners, these components of the treatment section are continuously subjected to fast pressure fluctuations, which contribute to high loading and therefore to rapid wear of these components.

Pressure fluctuations can additionally be transmitted to the treatment fluid, for example by a pump connected to the treatment fluid source or by other sources of oscillation connected to the line system.

Generally known for pulsating liquids is an oscillation damper, which comprises a hollow chamber defined in a housing and subdivided by a movable diaphragm into a liquid chamber and a gas chamber. The pressure fluctuations of the pulsating liquid are balanced out or damped as a result of the fact that the diaphragm can give way to a temporary pressure rise by means of intensified compression of the gas volume and, in the case of a temporary pressure drop, permits appropriate expansion of the gas volume. However, such oscillation dampers have the disadvantage that the edge of the diaphragm must be fixed to the housing in a liquid-tight and simultaneously stable manner and, particularly in this edge region, the diaphragm itself is subjected to intense continuous loading. Furthermore, the gas chamber must be sealed off adequately from the outside and it is necessary for means to be provided for filling the gas chamber and for setting the gas pressure, so that the known oscillation damper is overall of relatively complicated construction.

SUMMARY OF THE INVENTION

Having regard to the prior art discussed, according to one aspect of the present invention, a machine of the type described at the beginning is provided in such a way that pressure fluctuations of the treatment fluid, in particular pulsations in the treatment fluid, can be damped with preferably little expenditure on construction.

In accordance with one aspect of the present invention it is proposed that, in a machine of the type mentioned at the beginning, elastically deformable compensating material is provided, which is arranged in a fluid holding chamber of the treatment fluid source or of the treatment section or a damping device connected to the line connection or arranged in the latter and/or delimits such a fluid holding chamber, and/or elastically deformable compensating material is provided which, in at least one section of the line connection, defines or co-defines an effective line cross section.

As a result of the arrangement of the elastically deformable compensating material in the fluid holding chamber or the section of the line connection, the treatment fluid subjected to the pressure fluctuations comes into direct contact with the compensating material and can displace the latter more or less highly elastically, depending on the instantaneous pressure. The pressure fluctuations in the fluid can thus be partly balanced out or damped by the elastic deformation of the compensating material. In the event of a temporary increase in the pressure of the treatment fluid, the compensating material will specifically be deformed in such a way that the quantity of treatment fluid that can be held in the fluid holding chamber or the quantity of treatment fluid that can be transported per unit time in the line cross section increases, and thus the pressure rise is to some extent accommodated. Conversely, in the event of a temporary reduction in the pressure of the treatment fluid, the compensating material will be deformed in such a way that the quantity of treatment fluid that can be held in the fluid holding chamber or the quantity of treatment fluid that can be transported per unit time in the section of the line connection decreases and thus the pressure reduction is to some extent accommodated. Therefore, in a manner which is constructionally simple and thus cost-effective, damping of the pressure fluctuations occurring in the treatment fluid is possible.

The compensating material can be arranged and formed in such a way that it is compressed in the event of a rising pressure of the treatment fluid. Compression of the compensating material in the event of a rising pressure can have a positive effect on the durability of many compensating materials, since the structural stressing and therefore the risk of a continuous change in the material properties of the compensating material become lower during compression.

Alternatively, however, the compensating material can be arranged and formed in such a way that it is expanded in the event of a rising pressure of the treatment fluid. Depending on the actual configuration, a structurally particularly simple damping system can then result.

The subject matter of the present invention is also intended to include compensating material which, in the event of rising pressure of the treatment fluid, is compressed in some sections and expanded in some sections on account of its structure and arrangement. Furthermore, a plurality of compensating elements having the compensating material may be used, which can in each case be arranged and designed in such a way that, in the event of a rising pressure of the treatment fluid, some of the elements are compressed and other elements are expanded. In this way, a high degree of flexibility and freedom of construction is provided in order to match the damping properties of the system to specific requirements.

In order to configure a damping system of the machine according to the invention particularly simply and with the use of as few components as possible, it is proposed that the compensating material form at least one section of a delimiting wall of the fluid holding chamber or of the section of the line connection or at least one molding arranged in the fluid holding chamber or in a line cross section of the line connection. Thus, the compensating material can be given a dual function as a delimiting wall, on the one hand, and as a damping device for damping pressure fluctuations, on the other hand. The provision of a molding additionally reduces costs and effort from the point of view of production and maintenance.

In order to implement the present invention in the manner of a damping device which can be arranged or retrofitted in a straightforward manner in a machine of the type mentioned at the beginning, the provision of a housing structure, in which the compensating material is arranged, is proposed. It is then specifically possible for at least one compensating element having the compensating material to be arranged in the housing structure and, on its own or together with the latter, to delimit the fluid holding chamber or the section of the line connection, so that a fluid holding chamber or line connection section having at least one elastically deformable wall section is thus formed.

Alternatively or additionally, provision can be made for at least one compensating element having the compensating material to be arranged in the fluid holding chamber formed in a housing structure. In the case of a compensating element arranged in this way, it is even possible for the fixing of the compensating element to the housing structure to be rendered superfluous. Furthermore, the arrangement of the compensating element in the housing structure provides the advantage that it can come into contact with the treatment fluid with a particularly large part of its surface, in particular on all sides, and can thus be compressed without interactions with relatively large fixing areas on the housing structure.

If the compensating element is arranged in the fluid holding chamber, then it is possible for fluid to flow around it and/or through it. In this way, a large number of possible configurations result for setting up the damping and flow properties of the damping device as desired and matching them to the pressures and pressure fluctuations to be expected in the machine. For example, substantially the entire fluid holding chamber or line cross section can be filled with the compensating material, at least one channel leading through the compensating material in order to bring the treatment fluid into contact with the compensating material. Alternatively, the compensating material can be introduced in the form of strips or moldings which fill up less than half the fluid holding chamber or the line cross section, so that the treatment fluid flows around it or the treatment fluid flows past it.

In a further preferred embodiment, it is proposed that at least one hose-like or sleeve-like compensating element having the compensating material be provided, which accommodates treatment fluids or through which treatment fluid flows, in such a way that, in the event of a rising pressure of the treatment fluid, the effective line cross section of the compensating element increases. Such a hose-like or sleeve-like compensating element can be produced simply and, in such an arrangement, acts simultaneously as a limiting wall of the fluid holding chamber or of the section of the line connection.

In particular when a hose-like or sleeve-like compensating element is used, but also in the case of other compensating elements, it may be advantageous if the compensating element is designed with a stabilizing element surrounding the compensating material. In this way, a defined basic shape of the compensating element, for example the hose or sleeve shape, can be maintained even in the event of highly fluctuating pressures, and/or damage to the compensating element at relatively high pressures, for example bursting of the hose, can be prevented.

For a hose-like or sleeve-like compensating element, this stabilizing element can be achieved in such a way that the compensating element comprises two or more concentrically arranged hose layers, of which at least an inner hose layer is formed of compensating material. In this way, an outer of the hose layers can prevent excessive expansion of the inner compensating material in the event of rising pressure. The outer, stabilizing hose layer can in this case likewise be formed from elastically deformable material and thus simultaneously likewise influence the damping properties of the arrangement.

In general terms, the compensating material used in embodiments of the present invention can be formed from an elastically deformable foam, in particular a silicone foam, an EPDM elastomer foam, polyethylene foam or polypropylene foam. A foam of this type or foamed material has particularly advantageous elastic properties, it being possible for the damping characteristics of the material to be set in a simple way by choosing the foamed plastic, the density and the thickness of the foam. Hence, for different pressure ranges or pressure fluctuation ranges, a suitable foam can be produced.

The foam is preferably a closed-cell foam or a foam having an outer layer which is substantially impermeable to treatment fluid. In this way, it is possible to dispense with the use of a dividing wall or dividing diaphragm between the treatment fluid and the foam, since the air inclusions essential to the elasticity remain enclosed in the foam even in the event of contact between the foam and treatment fluid. For a particularly effective damping action, it is advantageous if the foam has a Shore hardness of approximately 6 Shore A to approximately 18 Shore A, preferably of approximately 10 Shore A to approximately 18 Shore A.

As already mentioned above, however, it is also possible to provide compensating material of substantially unfoamed material. In particular, an outer hose layer of a hose-like or sleeve-like compensating element can be produced from such a material. Suitable unfoamed compensating material is unfoamed elastomers, in particular silicone rubber or EPDM elastomer rubber. The unfoamed elastomer can have a Shore hardness of approximately 50 Shore A to approximately 80 Shore A, preferably of approximately 50 Shore A to approximately 70 Shore A.

With respect to the connection of the fluid holding chamber to the line connection of the treatment section, two connection principles may be used. According to a first connection principle, the fluid holding chamber may be connected via at least one fluid inlet to an upstream section of the line connection and via at least one fluid outlet to a downstream section of the line connection. In this way, the fluid holding chamber is arranged as a through-flow device in the flow path of the treatment fluid. A fluid holding chamber arranged in this way then acts in the manner of a section of the line connection in which the damping of pressure fluctuations is provided.

According to a second connection principle, the fluid holding chamber has a fluid passage which is connected to the line connection, branching off the latter. A damping device connected as a branch in this way substantially does not hinder the flow of the treatment fluid along the line connection but, nevertheless, the compensating material arranged in the damping device is in contact with the treatment fluid, so that pressure fluctuations in the treatment fluid can be balanced out or damped effectively.

In a further aspect of the invention, the flow of the treatment fluid may be limited by at least one throttling device assigned to the fluid holding chamber or to the section of the line connection. Such a throttling device can be provided, for example, at a fluid inlet or fluid outlet or another fluid passage through the housing structure or in the compensating material and offers a further possible way of influencing the damping characteristics of the system.

The damping system described according to the present invention can advantageously be used in an extremely wide range of treatment sections of a machine of the type mentioned at the beginning in which pressure fluctuations in a fluid line system are to be balanced out. However, the treatment section is particularly advantageously arranged in a drying section or before a calender of the machine. In this region, for the purpose of transverse moisture profiling of paper webs, water is discharged onto the paper web from valves which are switched in a pulsating manner, so that the flow rate of the water through the line connections leading to the valves fluctuates periodically.

In general, the action of the damping system according to an aspect of the invention is particularly effective if the treatment fluid is a treatment liquid, for example water, since liquids are barely compressible and are thus not capable of balancing out surges and pressure fluctuations.

In a further aspect of the invention, a damping device is arranged in or connected to a line connection between a fluid source and a device to be supplied with fluid. According to an aspect of the present invention, elastically deformable compensating material is provided in such a damping device, which material is arranged in or delimits a fluid holding chamber of the damping device. The damping device according to an aspect of the invention can advantageously be developed further with the inventive features described above in connection with the machine according to the invention for the production/processing of a material web.

A machine for at least one of the production or processing of a material web according to an aspect of the invention, comprises at least one treatment section in which the material web has a treatment fluid applied to it, a treatment fluid source connected to the treatment section via at least one line connection, and an elastically deformable compensating material arranged in a fluid holding chamber in the fluid flow path between the treatment fluid source and the treatment section.

According to other aspects of the invention, the web may be one of a fibrous web, paper or board. The compensating material may be formed so as to be compressed when pressure of the treatment fluid rises and to be expanded when pressure of the treatment fluid rises. The compensating material may form at least one section of one of, a delimiting wall of the fluid holding chamber, or a wall of the line connection. The compensating material may be a molding. The compensating material may be at least one molding arranged in the fluid holding chamber.

According to yet other aspects of the invention, the fluid holding chamber may be formed in a housing structure. The fluid may flow at least one of around or through the compensating material in the fluid holding chamber. The compensating material may be at least one of hose-like or sleeve-like shape, which one of, accommodates treatment fluid or through which treatment fluid flows, such that, in the event of a rising pressure of the treatment fluid, the effective line cross section of the compensating material increases.

According to other aspects of the invention, the machine may further comprise a stabilizing element surrounding the compensating material. The machine may further comprise at least two concentrically arranged hose layers formed outside of the compensating material. The compensating material may be formed from an elastically deformable foam, comprising at least one of a silicone foam, an EPDM elastomer foam, a polyethylene foam, or a polypropylene foam. The foam may be at least one of a closed-cell foam or a foam having an outer layer which is substantially impermeable to treatment fluid. The foam may have a Shore hardness of one of, approximately 6 Shore A to approximately 18 Shore A, or approximately 10 Shore A to approximately 18 Shore A.

At least an outer of the hose layers according to an aspect of the invention may be formed from a substantially unfoamed elastomer, comprising at least one of silicone rubber or EPDM elastomer rubber. The unfoamed elastomer may have a Shore hardness of one of, approximately 50 Shore A to approximately 80 Shore A, or approximately 50 Shore A to approximately 70 Shore A.

The fluid holding chamber according to an aspect of the invention may be connected via at least one fluid inlet to an upstream section of the line connection and via at least one fluid outlet to a downstream section of the line connection. The fluid holding chamber may have a fluid passage which is connected to the line connection and branches off the latter.

The machine according to another aspect of the invention may further comprise at least one throttling device for limiting flow of the treatment fluid and being located in one of, the fluid holding chamber, or in the section of the line connection, wherein the throttling device may be formed in the compensating material. The treatment section may be arranged one of, in a drying section, or before a calender of the machine. The treatment fluid may be at least one of liquid or water.

According to yet another aspect of the invention, a damping device arranged one of, in, or connected to a line connection between a fluid source and a device supplied with fluid, comprises a fluid holding chamber and an elastically deformable compensating material which at least one of, is arranged in, or delimits the fluid holding chamber.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein:

FIG. 3 shows a first exemplary embodiment of a damping device according to the invention which is hose-like;

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
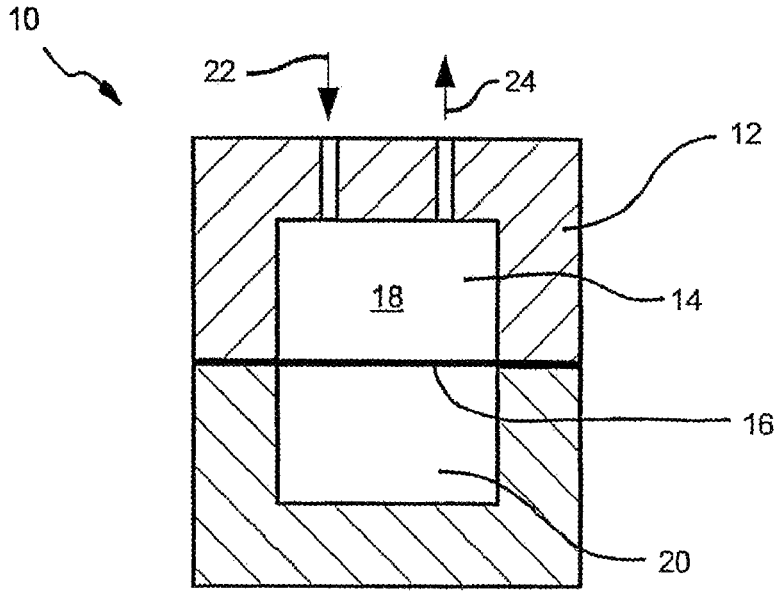
PRIOR ART Fig. 1
FIGS. 1 and 2 each show a prior art damping device.
Figure 2:
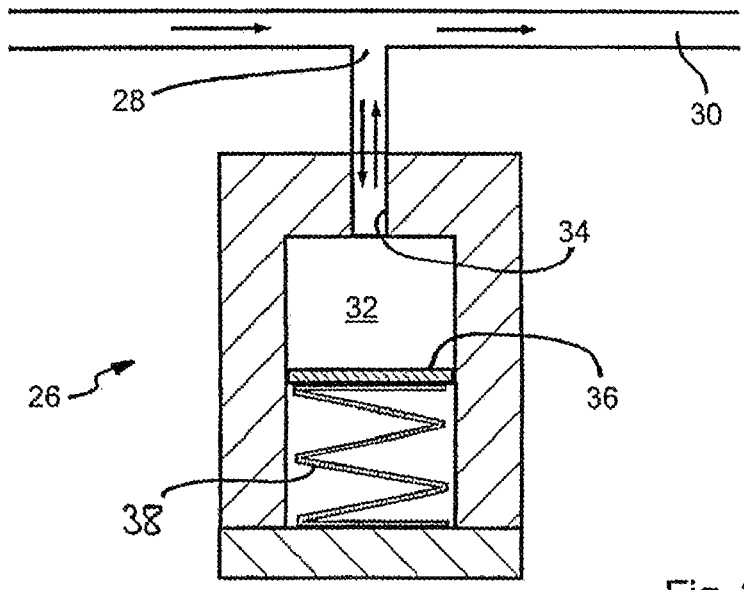
Fig. 2 PRIOR ART

For the purpose of illustration, two examples of damping devices from the prior art are shown schematically in FIGS. 1 and 2. In FIG. 1, the damping device 10 comprises a housing structure 12, which encloses a hollow chamber 14. The hollow chamber 14 is subdivided by an elastic diaphragm 16 into a liquid chamber 18 and a gas chamber 20. The damping device 10 is connected to a connecting line (not shown) via a liquid inlet 22 and a liquid outlet 24, which are connected to the liquid chamber 8.

During operation, the liquid chamber 8 is filled with treatment liquid and pressure fluctuations occurring in the line connection are transmitted to the liquid in the liquid chamber 8. Depending on the pressure fluctuations in the treatment liquid, the diaphragm 16 delimiting the liquid chamber 8 is deflected and the gas in the gas chamber 20 is compressed or expanded.

A further damping device 26 known from the prior art is illustrated in FIG. 2. This device 26 is connected to a line connection 30 via a T-shaped branch 28. The T-shaped branch 28 is connected to a liquid chamber 32 of the damping device 26 via a liquid passage 34. One wall of the liquid chamber 32 is formed by a piston 36, which is accommodated such that it can move in the housing structure and is prestressed by a spring 38 in the direction of a reduction in the size of the liquid chamber 32. In this design variant, particular effort is required for the liquid-tight sealing of a region between the piston and the housing wall in order to prevent treatment liquid running out into the space belonging to the spring 38.

FIGS. 3 to 15 show various exemplary embodiments of damping devices according to aspects of the invention with which the disadvantages of the damping devices of the prior art can be avoided to the greatest possible extent and which, according to an aspect of the invention, are provided and designed for use in a machine for the production/processing of a material web.

Figure 3:
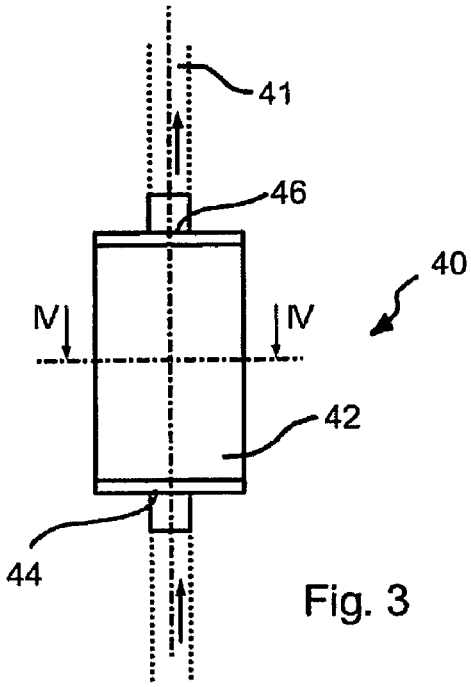
Figure 7:
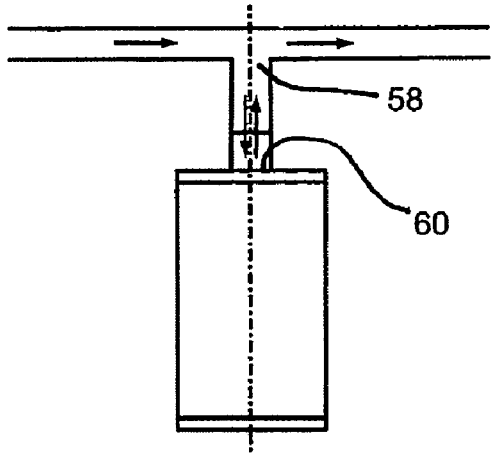
FIG. 7 shows an alternative connection principle for the damping devices of FIGS. 3 to 6.
Figure 4:
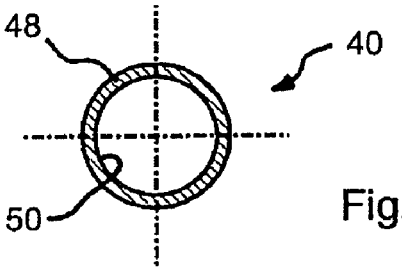
FIG. 4 shows a sectional view along a line IV-IV in FIG. 3.

In FIGS. 3 and 4, according to a first exemplary embodiment, a hose-like damping device 40 is illustrated, which can be integrated into a connecting line 41 as a through-flow device, so that treatment liquid can enter the liquid chamber 42 through a liquid inlet 44 and can emerge from the chamber again through an outlet 46.

One wall of a hose 48 forms a compensating element and is formed of a foamed material, for example silicone foam, EPDM elastomer foam (ethylene-propylene-diene rubber elastomer foam), polyethylene foam or polypropylene foam, which has a closed-cell structure, in order to prevent the treatment liquid from passing through to the outside. Alternatively, a liquid-impermeable layer can be formed or arranged on the inside 50 of the hose.

The diameter of the hose 48 is preferably between about 4 mm and about 15 mm, particularly preferably between about 6 mm and about 10 mm. The wall thickness of the hose 48 is preferably in the range from about 2 mm to about 10 mm, particularly preferably in the range from about 2 mm to about 6 mm. Furthermore, it is particularly advantageous if the density of the material of the hose 48 is in the range from about 0.2 to about 0.6 g/cm$^3$ and the hose material has a Shore hardness to DIN 53505 in the range from about 6 to about 18 Shore A, particularly preferably in the range from about 10 to about 18 Shore A. The length of the hose 48 is preferably in the range from about 50 mm to about 500 mm, particularly preferably in the range from about 100 mm to about 200 mm.

In the operationally ready state, the liquid chamber 42 of the hose 48 is filled substantially completely with the treatment liquid and the wall of the hose 48 formed from the elastic foam is expanded to a certain extent depending on the pressure of the treatment liquid. A pressure fluctuation occurring in the treatment liquid can then be accommodated by a change in the magnitude of the expansion of the hose material, so that a damping action is provided. In addition, the structure of this damping device 40 is extremely simple, since the hose wall 48, in addition to the function as a compensating element, is also assigned the function of the wall of the liquid chamber 42.

In one variant of this exemplary embodiment, the hose formed from the compensating material is provided not only as a hose section, as indicated in FIG. 3, but extends over a relatively long portion of the line connection. In particular, the entire line connection can also be formed from a hose having the compensating material.

Figure 5:
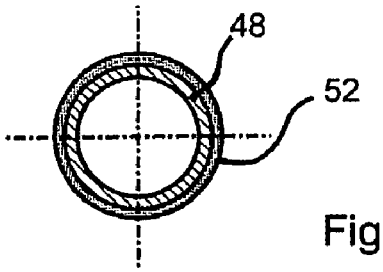
FIGS. 5 and 6 show a second and a third exemplary embodiment of the invention, respectively, which likewise have a hose-like structure.

The second exemplary embodiment of the invention, shown in FIG. 5, represents a further development of the first exemplary embodiment, shown in FIGS. 3 and 4. In the second exemplary embodiment, a sheath 52 is provided, which is arranged around the hose 48 and stabilizes the latter. The sheath 52 can be an elastic outer hose made of silicone or an EPDM elastomer. An outer hose having a Shore hardness in the range from about 50 to about 80 Shore A, particularly preferably in the range from about 50 to about 70 Shore A, and having a thickness in the range between about 0.5 and about 3 mm is particularly effective. Furthermore, an internal diameter of about 6 mm to about 25 mm, preferably of about 8 mm to about 18 mm, is advantageous. This diameter should be matched to the length of the hose, which is preferably between about 200 mm and about 1500 mm.

In order to increase or to further increase the stability of the hose according to the first exemplary embodiment or according to the second exemplary embodiment, the hose can additionally be provided with reinforcement in the form of a woven fabric surrounding the hose or a shell supporting the latter. In this way, deformation of the hose in the event of excessively low pressures or damage to the hose material in the event of excessively high pressures can reliably be avoided.

Figure 6:
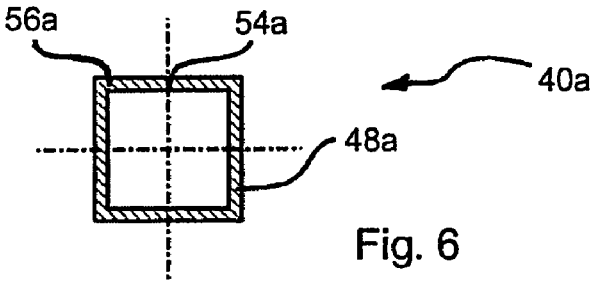

FIG. 6 shows a third exemplary embodiment of the invention, which differs from the damping device 40 of the first exemplary embodiment, shown in FIGS. 3 and 4, in that the wall of the hose 48*a* has a substantially rectangular shape in the cross section running at right angles to the hose running direction. Such a cross-sectional shape acts on the damping characteristics of the damping device to the effect that, in the event of relatively small pressure fluctuations, first of all the side walls 54*a* of the hose 48*a* bulge inwardly or outwardly, while only in the event of higher pressure fluctuations does a change in the expansion also occur in the corner regions 56*a*. In general, an extremely wide range of cross-sectional shapes for a hose-like damping device are conceivable, which have different damping characteristics.

The exemplary embodiments 1 to 3 illustrated hitherto have been described as through-flow devices. However, these damping devices can likewise also be connected to a T-shaped branch 58 according to FIG. 7, so that the hose-like damping device is then not arranged as a section of the line connection but as a branch. As opposed to the exemplary embodiments shown in FIGS. 3 to 6, the damping device according to FIG. 7 accordingly does not have separate inlets and outlets but is connected via only a single liquid passage 60.

With reference to FIGS. 8*a*, 8*b*, 9*a*, 9*b*, 10*a* and 10*b*, three further exemplary embodiments of the invention will now be described, in which moldings formed of compensating material are arranged in a housing structure.

Figure 8A:
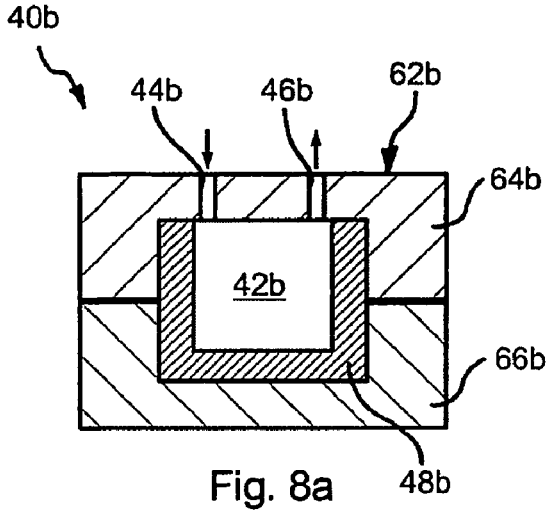
FIGS. 8*a* and 8*b* show damping devices of a fourth exemplary embodiment of the invention for two different connection possibilities.

In a fourth exemplary embodiment of the invention, shown in FIG. 8*a*, the damping device 40*b* has a box-shaped housing structure 62*b* which is assembled from an upper housing part 64*b* and a lower housing part 66*b*. The housing parts 64*b*, 66*b* are configured and connected to each other in such a way that they define between them a substantially closed liquid chamber 42*b*.

Compensating material 48*b* is fixed as a thick layer to the inner walls of the liquid chamber 42*b*, the regions of an inlet 44*b* and of an outlet 46*b* being cut out. Since, in this way, the major part of the inner wall of the housing structure 62*b* is clad with the compensating material 48*b*, a particularly large interaction area is provided between the treatment fluid in the liquid chamber 42*b* and the compensating material 48*b*. The treatment liquid accommodated in the liquid chamber 42*b* during the operation of the damping device 40*b* can thus transmit its pressure fluctuations effectively to the compensating material 48*b*, in order to compress the latter against the inner wall of the housing structure 62*b* in accordance with the instantaneous pressure and thus to dampen the pressure fluctuations.

Figure 9A:
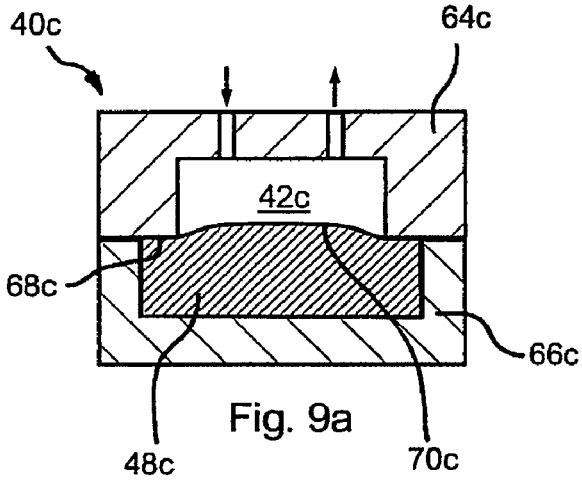
FIGS. 9*a* and 9*b* show damping devices of a fifth exemplary embodiment of the invention for two different connection possibilities.

In a fifth exemplary embodiment, shown in FIG. 9*a*, a molding 48*c* of compensating material is inserted into a liquid chamber 42*c* and fills about half the liquid chamber 42*c*. The molding 48*c* is held in its edge region with a form fit under prestress behind steps 68*c* of the housing structure 62*c* formed between a lower housing part 66*c* and an upper housing part 64*c*.

As a result of the prestress of the molding 48*c*, in its central region 70*c* this bulges somewhat into the region of the liquid chamber 42*c* filled by the treatment liquid. During the compensation of pressure fluctuations in the treatment liquid, the extent of this bulge will vary appropriately.

Figure 10A:
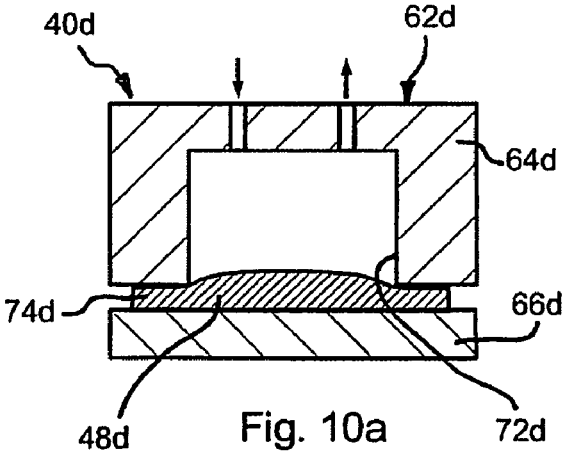
FIGS. 10*a* and 10*b* show damping devices of a sixth exemplary embodiment of the invention for two different connection possibilities.

A sixth exemplary embodiment of a damping device 40*d* according to the invention, shown in FIG. 10*a*, is constructed from an upper housing half 64*d* having a depression 72*d* and a cover plate 66*d*. The upper housing part 64*d* is connected to the cover plate 66*d* in such a way that they define a liquid chamber 42*d* between them. Between the upper housing part 64*d* and the cover plate 66*d*, a thick, plate-like compensating element 48*d* is arranged in such a way that, in its outer edge region 74*d*, it is clamped in between the upper housing part 64*d* and the cover plate 66*d*. In this way, the compensating element 48*d* is not only fixed securely in the damping device 40*d* but at the same time serves as a seal for the connection between the upper housing part 64*d* and the cover plate 66*d*. In a manner similar to that in the fifth exemplary embodiment, the compensating element 48*d* of the sixth exemplary embodiment also bulges in its central region in the direction of the part of the liquid chamber 42*d* filled with treatment liquid.

Figure 8B:
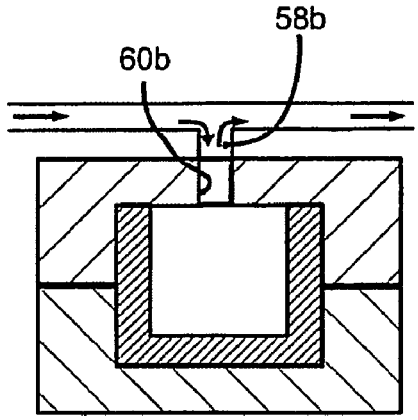
Figure 9B:
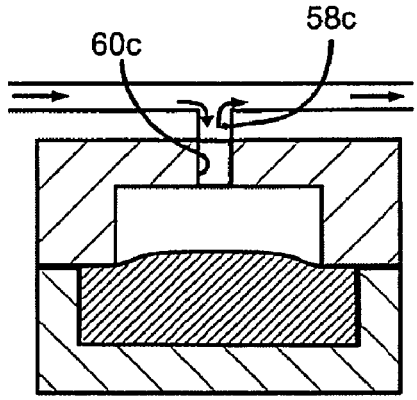
Figure 10B:
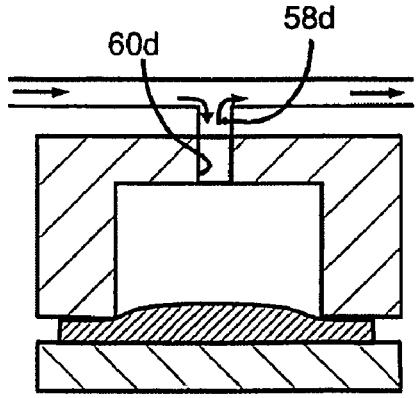

The damping devices shown in FIGS. 8*a*, 9*a*, 10*a* are provided as through-flow devices having a liquid inlet and a liquid outlet. FIGS. 8*b*, 9*b* and 10*b* show the damping devices of the fourth, fifth and sixth exemplary embodiments in each case in the variant having only one liquid passage 60*b*, 60*c* and 60*d*, which is connected to a line connection via a T-shaped branch 58*b*, 58*c* and 58*d*.

In the following text, with reference to FIGS. 11 to 15, exemplary embodiments 7 to 11 will be described, which are in each case constructed as through-flow devices having at least one compensating element arranged in a housing structure.

Figure 11:
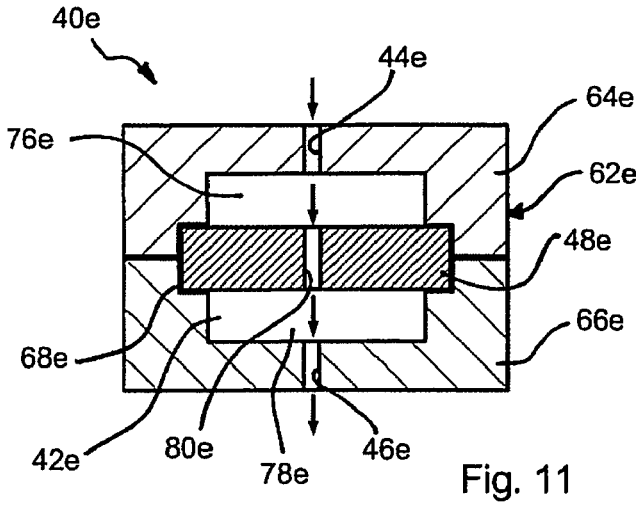
FIGS. 11 to 15 show exemplary embodiments 7 to 11 of the invention, in which the damping devices are arranged as through-flow devices.

In detail, a damping device 40*e* of a seventh exemplary embodiment of the invention, shown in FIG. 11, has a housing structure 62*e*, which is assembled from an upper housing part 64*e* and a lower housing part 66*e*, which define a liquid chamber 42*e* between them. A compensating element 48*e* is held in a form fit in corresponding cut-outs 68*e* in the butt region between the upper housing part 64*e* and the lower housing part 66*e*. The compensating element 48*e* subdivides the liquid chamber 42*e* into an upstream region 76*e* connected to a liquid inlet 44*e* and a downstream region 78*e* connected to a liquid outlet 46*e*. For the interchange of liquid between the upstream region 76*e* and the downstream region 78*e*, the compensating element 48*e* has a throttling passage 80*e*, which has a defined flow cross section. In order that this flow cross section does not change as a result of the compression or relief of the stress of the compensating element 48*e*, it can be reinforced, for example by a metal sleeve or the like.

Figure 12:
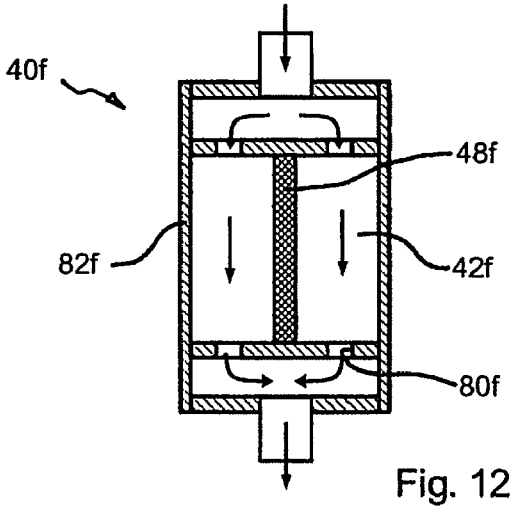

In the eighth exemplary embodiment of the invention, shown in FIG. 12, a compensating element 48*f* is arranged as a dividing wall in the middle of an elongated liquid chamber 42*f* and is aligned along the flow direction of the treatment liquid, so that the treatment liquid flows laterally past the compensating element 48*f*. The compensating element 48*f* thus subdivides the liquid chamber 42*f* into two flow channels running in parallel, whose effective line cross sections are changed by elastic deformation of the compensating element 48*f* in accordance with the pressure of the treatment liquid. The flow of the treatment liquid in each flow channel can in each case be limited by a throttle 80*f* arranged at the end of each flow channel. The wall 82*f* delimiting the liquid chamber 42*f* on the outside can be rigid or formed in the manner of a hose from a flexible material, which can likewise deform as a function of the pressure of the treatment liquid.

Figure 13:
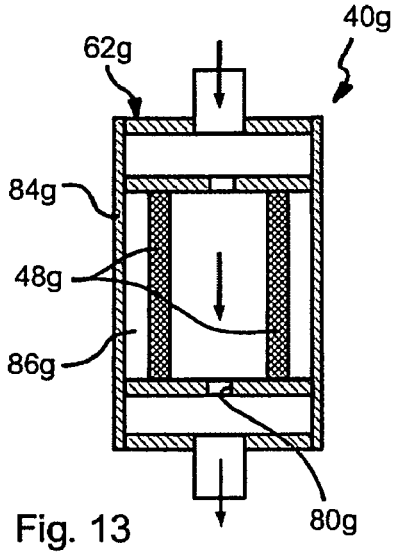

A ninth exemplary embodiment of the damping device according to the invention is illustrated in FIG. 13. In this damping device, a hose-like damping element 48*g* made of compensating material is fixed in a housing structure 62*g*. The hose-like compensating element 48*g* is surrounded by a housing wall 84*g* or else by a flexible outer hose, an interspace 86*g*, for example filled with air, being left between the housing wall/outer hose 84*g* and the outside of the hose-like compensating element 48*g*.

In the operationally ready state of the damping device 40*g*, treatment liquid flows through the hose-like compensating element 48*g*, pressure fluctuations occurring in the treatment liquid being damped by elastic deformation of the hose-like compensating element 48*g* in the radial direction. The damping characteristic achieved is influenced on the one hand by the elastic deformation of the hose-like compensating element 48*g* and on the other hand by the compression or expansion of the air present in the interspace 86*g*.

In a way similar to the eighth exemplary embodiment, in the ninth exemplary embodiment, the flow of the treatment liquid through the hose-like compensating element 48*g* can also be limited by a throttle 80*g* arranged at the end of the hose.

Figure 14:
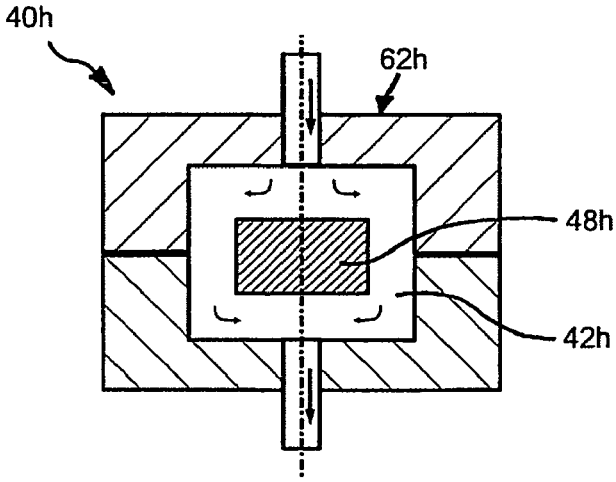

Furthermore, FIG. 14 shows a tenth exemplary embodiment of a damping device 40*h* according to the invention, in which a molding 48*h* of compensating material is arranged in a free-floating manner in a liquid chamber 42*h* defined by a housing structure 62*h*. Treatment liquid thus flows around the molding 48*h* on all sides, so that compression forces acting on the molding 48*h* act uniformly from all sides. In such an arrangement, a particularly well defined damping characteristic can be achieved. Furthermore, it is possible to dispense with additional arrangements for fixing the molding 48*h* to the housing structure 62*h*.

Figure 15:
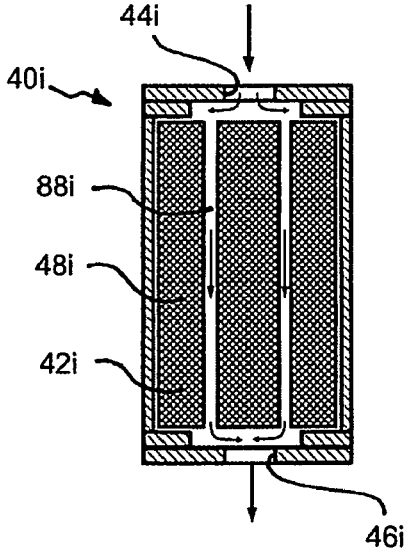

FIG. 15 shows an eleventh exemplary embodiment of a damping device 40*i*. In this exemplary embodiment, the major part of the liquid chamber 42*i* is filled with compensating material 48*i*, channels 88*i* for the passage of treatment liquid being formed in the compensating material 48*i*. The number and the course of the channels 88*i* can be chosen as desired, provided that transport of the treatment fluid from the liquid inlet 44*i* to the liquid outlet 46*i* remains ensured.

In relation to the exemplary embodiments 7 to 11 according to FIGS. 11 to 15, it should also be stated that the housing structures defining the liquid chamber in each case can also be formed by a section of the line connection itself. More precisely, compensating material which, with account to its shape and type of fixing, corresponds to the exemplary embodiments of FIGS. 11 to 15, can be inserted into a section of a line connection which is already present and, for example, conventional. The treatment liquid will then flow around, flow through or pass the compensating material and the damping device assumes a particularly simple configuration. In this way, a damping device can also be retrofitted particularly simply in a machine of the type mentioned at the beginning.

Although the present invention is not limited to a specific operating pressure, the embodiments of the invention have proven to be advantageous in particular for a pressure in the range between about 1.5 bar and about 4 bar.

Figure 16:
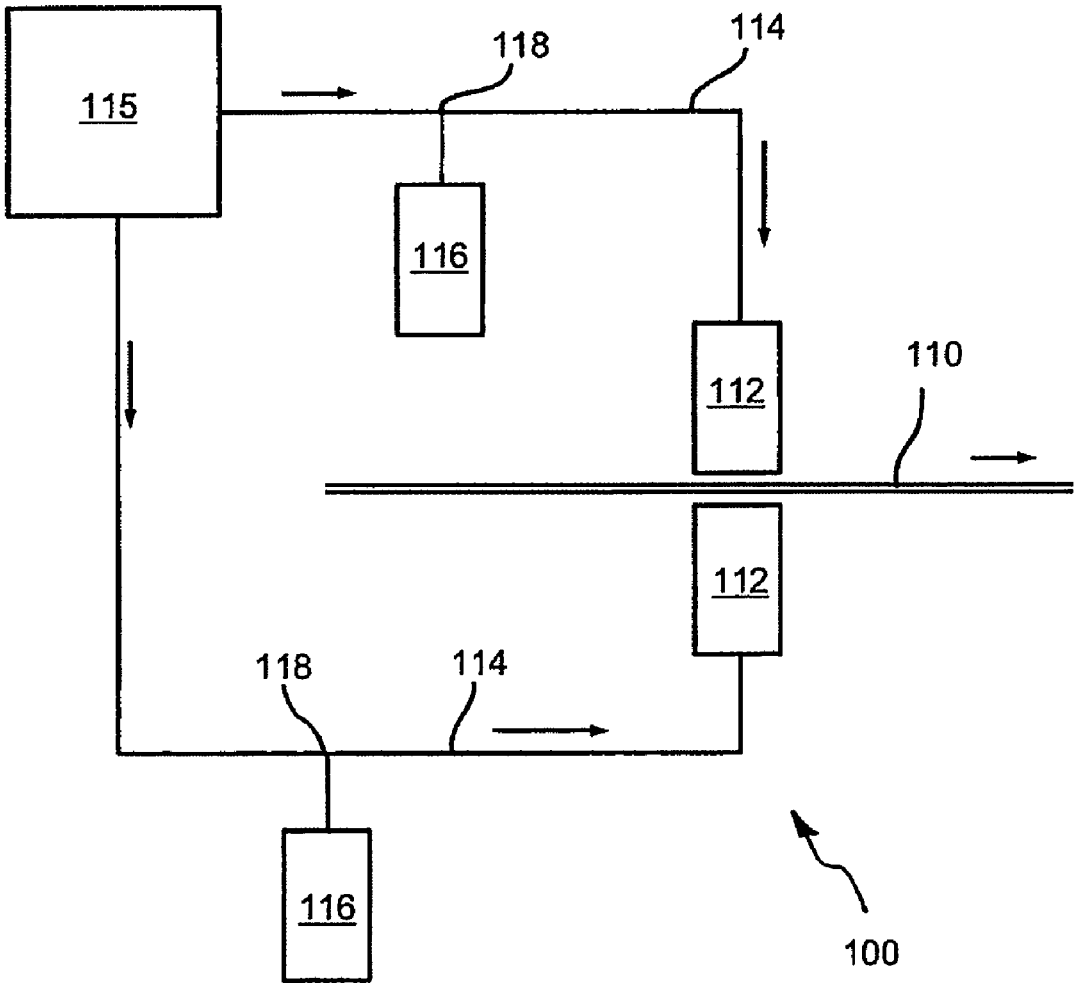
FIG. 16 shows a schematic illustration of an exemplary embodiment of a machine according to the invention for the production/processing of a material web.

FIG. 16 illustrates, schematically, an exemplary embodiment of a machine 100 constructed in accordance with the invention for the production/processing of a material web 110, specifically a paper web 110. The machine 100 supplies the moving paper web 110 intermittently with water via nozzle moisteners 112 arranged on both sides of the paper web 110. The nozzle moisteners 112 are connected to a water feed 115 via a line connection 114 for this purpose. In order to damp pressure fluctuations occurring in the line connection 114 as a result of the pulsating operation of the nozzle moisteners 112, damping devices 116 of the type described are connected to the connecting lines 114 via T branches 118.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The invention claimed is:

1. A machine for at least one of the production or processing of a material web, comprising:

at least one treatment section in which the material web has a treatment fluid applied to it;

a treatment fluid source connected to the treatment section via at least one line connection; and an elastically deformable compensating material arranged in a fluid holding chamber in the fluid flow path between the treatment fluid source and the treatment section, wherein the treatment fluid source, the at least one line connection and the fluid holding chamber contain the same treatment fluid, and the elastically deformable compensating material is configured to damp the same treatment fluid, and wherein the compensating material forms at least one section of one of, a delimiting wall of the fluid holding chamber, or a delimiting wall of the line connection.

2. The machine as claimed in claim 1, wherein the web is one of a fibrous web, paper or board.

3. The machine as claimed in claim 1, wherein the compensating material is formed so as to be compressed when pressure of the treatment fluid rises.

4. The machine as claimed in claim 1, wherein the compensating material is formed so as to be expanded when pressure of the treatment fluid rises.

5. The machine as claimed in claim 1, wherein the compensating material is a molding.

6. The machine as claimed in claim 1, wherein the compensating material is at least one molding arranged in the fluid holding chamber.

7. The machine as claimed in claim 1, wherein the compensating material is at least one of hose-like or sleeve-like shape, which one of, accommodates treatment fluid or through which treatment fluid flows, such that, in the event of a rising pressure of the treatment fluid, the effective line cross section of the compensating material increases.

8. The machine as claimed in claim 7, further comprising a stabilizing element surrounding the compensating material.

9. The machine as claimed in claim 7, further comprising at least two concentrically arranged hose layers formed outside of the compensating material.

10. The machine as claimed in claim 9, wherein at least an outer of the hose layers is formed from a substantially unfoamed elastomer, comprising at least one of silicone rubber and EPDM elastomer rubber.

11. The machine as claimed in claim 10, wherein the unfoamed elastomer has a Shore hardness of one of, approximately 50 Shore A to approximately 80 Shore A.

12. The machine as claimed in claim 11, wherein the unfoamed elastomer has a Shore hardness of approximately 50 Shore A to approximately 70 Shore A.

13. The machine as claimed in claim 1, wherein the fluid holding chamber is formed in a housing structure.

14. The machine as claimed in claim 1, wherein fluid flows at least one of around or through the compensating material in the fluid holding chamber.

15. The machine as claimed in claim 1, wherein the compensating material is formed from an elastically deformable foam, comprising at least one of a silicone foam, an EPDM elastomer foam, a polyethylene foam, or a polypropylene foam.

16. The machine as claimed in claim 15, wherein the foam is at least one of a closed-cell foam or a foam having an outer layer which is substantially impermeable to treatment fluid.

17. The machine as claimed in claim 15, wherein the foam has a Shore hardness of approximately 6 Shore A to approximately 18 Shore A.

18. The machine as claimed in claim 17, wherein the foam has a Shore hardness of approximately 10 Shore A to approximately 18 Shore A.

19. The machine as claimed in claim 1, wherein the fluid holding chamber is connected via at least one fluid inlet to an upstream section of the line connection and via at least one fluid outlet to a downstream section of the line connection.

20. The machine as claimed in claim 1, wherein the fluid holding chamber has a fluid passage which is connected to the line connection and branches off the latter.

21. The machine as claimed in claim 1, further comprising at least one throttling device for limiting flow of the treatment fluid, the throttling device being located in one of, the fluid holding chamber or the section of the line connection, and wherein the throttling device is formed in the compensating material.

22. The machine as claimed in claim 1, wherein the treatment section is arranged one of, in a drying section, or before a calender of the machine.

23. The machine as claimed in claim 1, wherein the treatment fluid is at least one of liquid or water.

24. The machine as claimed in claim 1, wherein the compensating material forms at least one section of one of, a delimiting wall of the fluid holding chamber, the delimiting wall of the connection, or at least one molding arranged in one of, the fluid holding chamber or in a line cross section of the line connection.

25. A damping device arranged one of in or connected to a line connection between a fluid source and a device supplied with fluid, comprising a fluid holding chamber and an elastically deformable compensating material which at least one of, is arranged in, or delimits the fluid holding chamber, wherein the fluid source, the line connection and the fluid holding chamber contain a same treatment fluid, and the elastically deformable compensating material is configured to damp the same treatment fluid, and wherein the compensating material forms at least one section of one of, a delimiting wall of the fluid holding chamber, or a delimiting wall of the line connection.

* * * * *